US008365348B2

(12) United States Patent
Hanschur et al.

(10) Patent No.: US 8,365,348 B2
(45) Date of Patent: Feb. 5, 2013

(54) VACUUM CLEANER HAVING A HOLDING DEVICE FOR HOLDING A VACUUMING TOOL IN A PARKED POSITION

(75) Inventors: Mark Hanschur, Bielefeld (DE); Volker Gerth, Bielefeld (DE); Klemens Andrup, Verl (DE); Martin Roth, Bielefeld (EA)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 13/184,597

(22) Filed: Jul. 18, 2011

(65) Prior Publication Data

US 2012/0017388 A1 Jan. 26, 2012

(30) Foreign Application Priority Data

Jul. 20, 2010 (EP) ..... 10401109
Jul. 20, 2010 (EP) ..... 10401110

(51) Int. Cl.
*A47L 9/30* (2006.01)

(52) U.S. Cl. ..... 15/323; 15/324; 15/339

(58) Field of Classification Search ..... 15/323, 15/324, 339; *A47L 9/30*
See application file for complete search history.

(56) References Cited

U.S. PATENT DOCUMENTS

| | | | | |
|---|---|---|---|---|
| 2,637,062 | A * | 5/1953 | Sutton et al. | 15/324 |
| 5,125,127 | A | 6/1992 | Bach et al. | |
| 5,560,076 | A | 10/1996 | Leung | |
| 5,983,443 | A * | 11/1999 | Redding | 15/324 |
| 6,256,832 | B1 | 7/2001 | Dyson | |
| 2004/0163200 | A1 * | 8/2004 | Overvaag et al. | 15/324 |

FOREIGN PATENT DOCUMENTS

| | | | |
|---|---|---|---|
| DE | 8523389 | U1 | 5/1989 |
| DE | 4036314 | A1 | 5/1991 |
| DE | 4414370 | C1 | 5/1995 |
| GB | 2317817 | A | 4/1998 |

OTHER PUBLICATIONS

European Patent Office, European Search Report in European Patent Application No. 10 40 1110 (Feb. 28, 2011).
Miele Bodenpflege-Geräte, Fachhandels-Programm, Stand: Oct. 2009 [Miele floor care appliance specialist retailer's catalogue of Oct. 1, 2009], pp. 17/18 and 32/33.

* cited by examiner

*Primary Examiner* — David Redding
(74) *Attorney, Agent, or Firm* — Leydig, Voit & Mayer, Ltd.

(57) ABSTRACT

A vacuum cleaner includes a housing having at least one holding device configured to receive a vacuuming tool in a parked position and at least one illumination device associated with the holding device.

10 Claims, 2 Drawing Sheets

VACUUM CLEANER HAVING A HOLDING DEVICE FOR HOLDING A VACUUMING TOOL IN A PARKED POSITION

CROSS REFERENCE TO RELATED APPLICATIONS

This application claims priority to European Patent Application Nos. EP 10 401 109.3 and EP 10 401 110.1, both of which were filed on Jul. 20, 2010 and both of which are hereby incorporated by reference herein in their entirety.

FIELD

The present invention relates to a vacuum cleaner, in particular a canister vacuum cleaner, including a housing which is provided with at least one holding device for holding a vacuuming tool in a parked position.

BACKGROUND

DE 40 36 314 C2, which is incorporated by reference herein, describes canister vacuum cleaners having a floor nozzle connected to a suction hose and a suction wand, and with holding means on the housing and on the suction wand or the base unit, which holding means interact to hold the wand to the housing in a parked position after completion of the vacuuming operation.

The Assignee of the present invention manufactures and sells a canister vacuum cleaner under the model number S5311, for example, which is provided with three holding devices (see "Miele Bodenpflege-Geräte, Fachhandels-Programm, Stand: 1. Oktober 2009" [Miele floor care appliance specialist retailer's catalogue of Oct. 1, 2009] pages 17/18 and 32/33). In the rear portion of the housing, there is provided a first holding device which, when the vacuum cleaner is in its operating position (standing on its wheels), receives a latching element provided on a floor nozzle coupled to the vacuum cleaner via a suction hose and a suction wand. This holding device is intended for short breaks during vacuuming. Two additional holding devices are provided on the sides of the housing to receive the floor nozzle when the vacuum cleaner is in a storage position (standing on the rear side of the housing). This is the position in which the vacuum cleaner is often stored after use.

SUMMARY

In an embodiment, the present invention provides a vacuum cleaner including a housing having at least one holding device configured to receive a vacuuming tool in a parked position and at least one illumination device associated with the holding device.

BRIEF DESCRIPTION OF THE DRAWINGS

An exemplary embodiment of the present invention is described in more detail below and schematically shown in the drawings, in which.

DETAILED DESCRIPTION

In an embodiment, an aspect of the present invention is to provide a vacuum cleaner that makes it easier for the user to insert the vacuuming tool into the holding device.

Some advantages of the present invention are achieved by associating the holding device with at least one illumination device. This allows the user to clearly see the holding device even in a dark environment, which makes it easier for the latching element on the vacuuming tool to be inserted into the holding device.

The illumination device may advantageously be disposed in the holding device, where it acts directly at the critical site. If the holding device is divided into an insertion region and a holding region, it is suitable to provide illumination devices in both the insertion region and the holding region.

Additionally or alternatively, an illumination device may be disposed next to the holding device. This makes it possible to illuminate the floor area during vacuuming Good illumination in dark rooms is achieved in particular when an illumination device is disposed in both the holding device and next to it.

When illuminated holding devices are provided on both sides of the housing, greater flexibility is provided for the storage of the vacuum cleaner.

In an embodiment, the illumination device includes at least one light source disposed in the housing and a light guide associated with the light source and extending to the surface of the housing. In this manner, a protected flush fit is achieved.

Further, the illumination device can be associated with a circuit means for enabling the holding device to be illuminated at least for a short period of time after the vacuum cleaner is turned off or after the vacuum cleaner is disconnected from the mains voltage supply. Typically, the vacuum cleaner is parked after the fan is turned off using a main switch. Delayed switching off of the illumination ensures that the user continues to see the holding device during parking, allowing him or her to place the vacuuming tool into the parked position only at this point. For this purpose, suitable times are between 30 and 60 seconds. Technically, it is also possible to perform control while the fan (vacuum cleaner) is off and the power plug is making contact such that the illumination is turned off with a delay after pulling the power plug. However, this may be unfavorable for reasons of energy economy.

Figure 1:
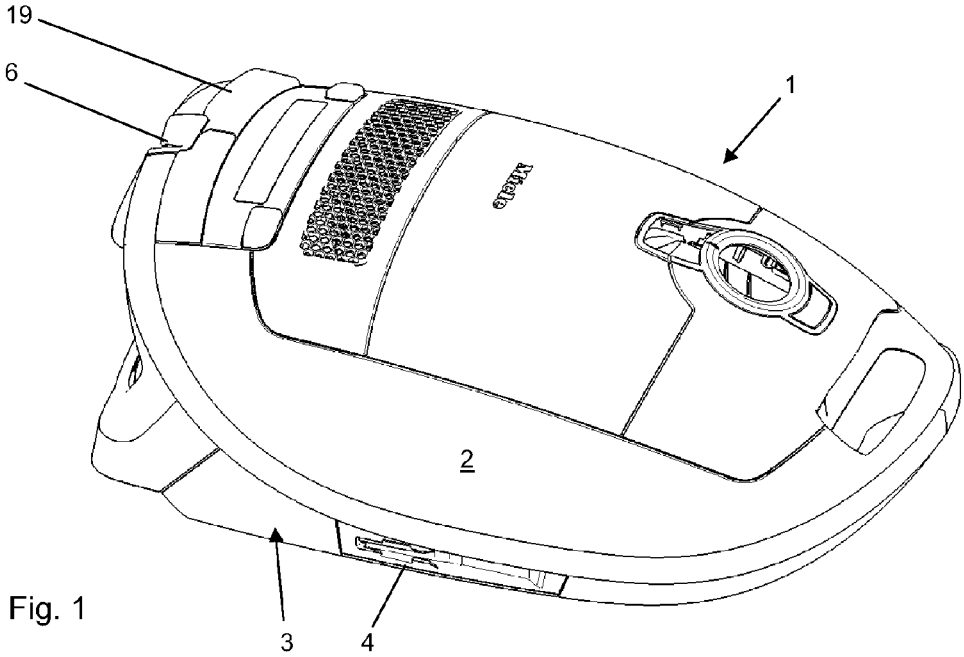
FIG. 1 is a perspective top view of a vacuum cleaner having a holding device, shown in the operating position.
Figure 2:
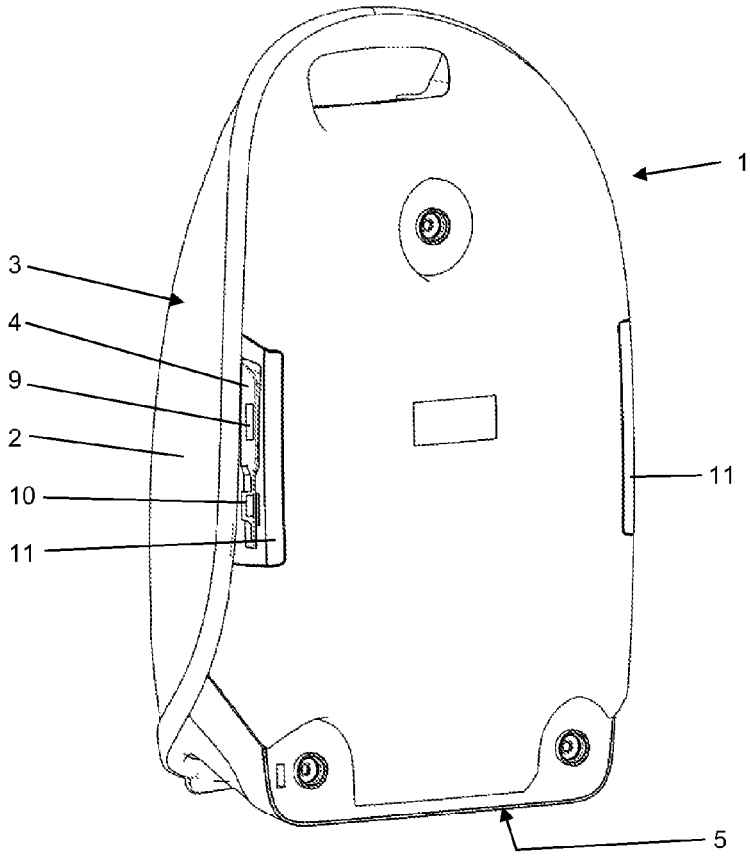
FIG. 2 is a view showing the vacuum cleaner of FIG. 1 in a storage position.

FIG. 1 shows a vacuum cleaner 1 in the operating position; i.e., with the wheels on the floor. Housing 2 of vacuum cleaner 1 is provided with a holding device 4 in its right portion 3, as seen in the pulling direction. The holding device is adapted to receive a corresponding latching element provided on a vacuuming tool, in particular on a floor nozzle. In this manner, a so-called parked position is provided. FIG. 2 shows vacuum cleaner 1 standing on rear housing side 5 in a so-called "storage position". In FIGS. 1 and 2, holding device 4 can be seen in the right housing portion. In FIG. 1, an additional holding device 6 can be seen in the rear portion of the housing. A third holding device is provided on the left side of the housing. In accordance with an embodiment of the present invention, the two lateral holding devices 4 of the illustrated vacuum cleaner are provided with illumination devices (see also FIGS. 2 and 4).

Figure 3:
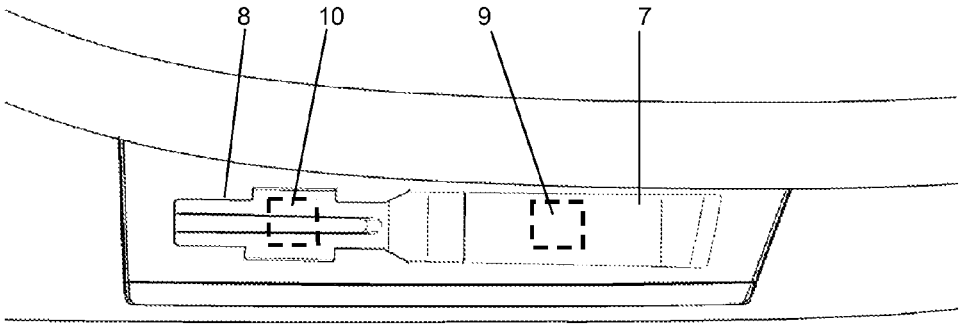
FIG. 3 is a view of a portion of the vacuum cleaner in the region of a holding device.

As can be seen in FIG. 2, and particularly in FIG. 3, lateral holding devices 4 include an insertion region 7 and a holding region 8 for the latching element provided on the floor nozzle.

The two regions 7 and 8 are each provided with a point-type illumination device, hereinafter referred to as point lights 9, 10. An additional, strip-shaped illumination device is disposed under each of the lateral holding devices, these additional illumination devices hereinafter being referred to as light strips 11. Point lights 9, 10 make it easier for the user to insert the latching element, while light strip 11 additionally serves to illuminate the area being vacuumed, and even to illuminate the space where the vacuum cleaner is stored.

Figure 4:
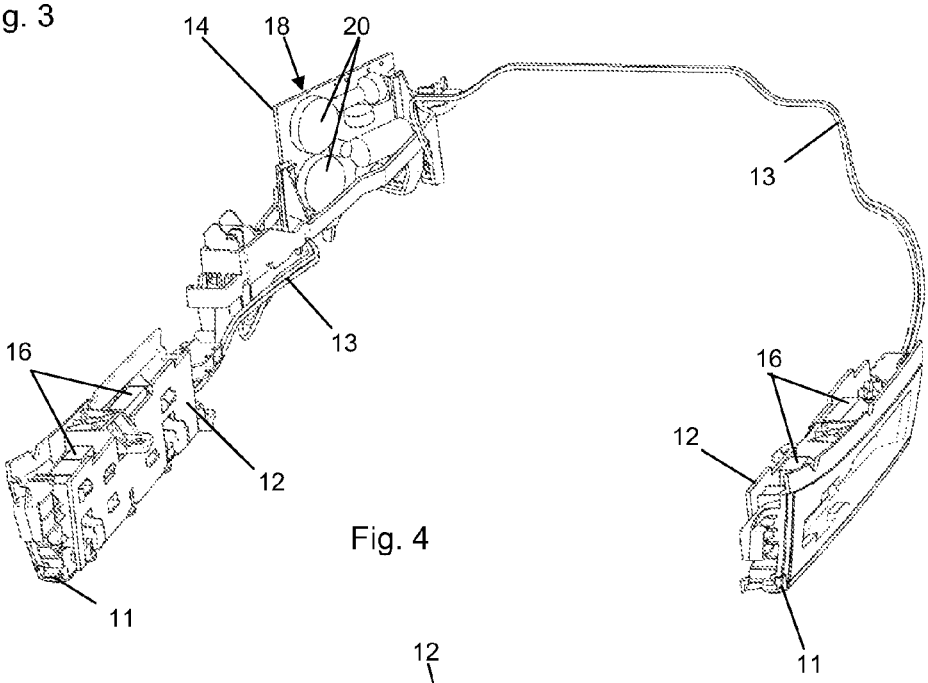
FIG. 4 is a detail view of the illumination device of the vacuum cleaner.
Figure 5:
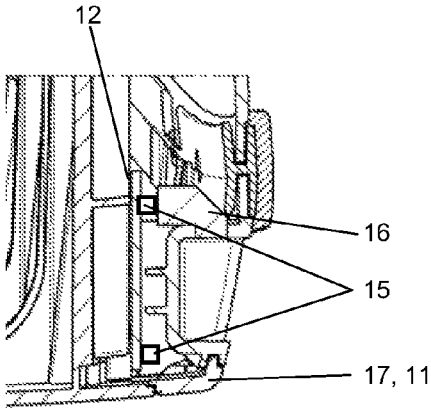
FIG. 5 is a partial section through the vacuum cleaner in the region of a holding device.

FIG. 4 is a detail view showing illumination devices 9, 10 and the lateral holding devices. At both sides, there are shown illumination printed circuit boards 12 which, in the assembled condition, are located inside the housing. The illumination printed circuit boards are connected by an electric cable 13 to power supply and control electronics 14. Each illumination printed circuit board has mounted thereon a plurality of LEDs 15 as light sources (see FIG. 5). Light guides 16 lead from the light sources of each illumination printed circuit board to the insertion and holding regions, where they provide point lights 9 and 10. Additional LEDs 15 are associated with a transparent cover 17, which also acts as a light guide and provides light strip 11. The surfaces of light guides 16 and 17 are flush with the surface of housing 2.

Power supply and control electronics 14 are equipped with a circuit means 18 adapted to also turn on illumination devices 9 through 11 upon actuation of main switch 19 (see FIG. 1). Moreover, circuit means 18 includes two capacitors 20 which maintain power to illumination printed circuit boards 12 for from 30 to 60 seconds after the main switch has been actuated to turn vacuum cleaner 1 off. This time is sufficient for the illumination to continue until the power plug is pulled, vacuum cleaner 1 is parked and the latching element is inserted.

While the invention has been particularly shown and described with reference to preferred embodiments thereof, it will be understood by those skilled in the art that various changes in form and details may be made therein without departing from the spirit and scope of the invention.

What is claimed is:

1. A canister vacuum cleaner comprising:

a canister housing including at least one holding device configured to receive a vacuuming tool in a parked position; and at least one illumination device disposed on the canister housing, associated with the holding device and disposed in a proximity of the holding device.

2. The vacuum cleaner recited in claim 1, wherein the at least one illumination device is disposed in the holding device.

3. The vacuum cleaner recited in claim 2, wherein the holding device includes an insertion region and a holding region, and wherein the at least one illumination device includes a first illumination device disposed in the holding region and a second illumination device disposed in the insertion region.

4. A vacuum cleaner comprising:

a housing including at least one holding device configured to receive a vacuuming tool in a parked position;

at least one illumination device associated with the holding device; and wherein the holding device is illuminated and disposed on a first side of the vacuum cleaner, and wherein another holding device is illuminated and disposed on a second side of the vacuum.

5. The vacuum cleaner recited in claim 1, wherein the at least one illumination device includes a first light source disposed in the housing and a light guide associated with the light source and extending to a surface of the housing.

6. A vacuum cleaner comprising:

a housing including at least one holding device configured to receive a vacuuming tool in a parked position;

at least one illumination device associated with the holding device; and a circuit associated with the at least one illumination device, the circuit being configured to illuminate the at least one illumination device so as to enable illumination of the holding device for at least a short period of time after the vacuum cleaner is turned off or after the vacuum cleaner is disconnected from a mains voltage supply.

7. The vacuum cleaner recited in claim 6, wherein the short period of time is at least 20 seconds.

8. The vacuum cleaner recited in claim 7, wherein the short period of time is within a range between 30 and 60 seconds.

9. The vacuum cleaner recited in claim 6, wherein the circuit includes an energy storage device.

10. The vacuum cleaner recited in claim 9, wherein the energy storage device is a capacitor.

* * * * *